United States Patent [19]

Nakaoka et al.

[11] 4,050,959

[45] Sept. 27, 1977

[54] PROCESS OF MAKING A HIGH STRENGTH COLD REDUCED STEEL SHEET HAVING HIGH BAKE-HARDENABILITY AND EXCELLENT NON-AGING PROPERTY

[75] Inventors: Kazuhide Nakaoka; Kenji Araki, both of Yokohama; Koji Iwase, Machida; Yasuo Koike, Yokohama; Shiro Fukunaka, Fukuyama, all of Japan

[73] Assignee: Nippon Kokan Kabushiki Kaisha, Tokyo, Japan

[21] Appl. No.: 631,929

[22] Filed: Nov. 14, 1975

[30] Foreign Application Priority Data

Nov. 18, 1974 Japan ..... 49-132006

[51] Int. Cl.[2] ..... C21D 9/46

[52] U.S. Cl. ..... 148/12.3; 148/12 F; 148/12.4

[58] Field of Search ..... 148/36, 12 C, 12 F, 148/12.3, 12.4, 142, 143, 144

[56] References Cited

U.S. PATENT DOCUMENTS

| | | | |
|---|---|---|---|
| 3,806,376 | 4/1974 | Toda et al. | 148/12 C |
| 3,839,095 | 10/1974 | Kubotera et al. | 148/12 C |
| 3,853,639 | 12/1974 | Hughes | 148/12 |
| 3,865,645 | 2/1975 | Takahashi et al. | 148/12.3 |
| 3,904,446 | 9/1975 | Uchida et al. | 148/12 F |
| 3,920,487 | 11/1975 | Gondo et al. | 148/12.3 |
| 3,947,293 | 3/1976 | Takechi et al. | 148/12 F |

FOREIGN PATENT DOCUMENTS

| | | | |
|---|---|---|---|
| 2,107,640 | 9/1971 | Germany | 148/12.3 |
| 2,263,431 | 8/1973 | Germany | 148/12.3 |

*Primary Examiner*—Arthur J. Steiner
*Attorney, Agent, or Firm*—Flynn & Frishauf

[57] ABSTRACT

When a cold reduced steel of which chemical composition is substantially controlled within the range of 10x[S]% to 2.00% [Mn], 0.003 to 0.02% [N] and ($<5\times10^{-4}$)/[N]% [Al] is subjected to a full continuous annealing process comprising a heating-up step of $Ac_1$ to 900° C × 5 to 180 sec., a rapid cooling step of the heating-up temperature to about room temperature by water-spray, reheating step of the room temperature to 150° C to 450° C × 5 to 300 sec., and then final cooling- and coiling step, high bake-hardenability and excellent non-aging property are given to the above steel with ease.

7 Claims, 2 Drawing Figures

PROCESS OF MAKING A HIGH STRENGTH COLD REDUCED STEEL SHEET HAVING HIGH BAKE-HARDENABILITY AND EXCELLENT NON-AGING PROPERTY

The present invention concerns an improvement of making high strength cold reduced steel sheet and more particularly it concerns a specific improvement for a full continuous annealing process following cold reducing to obtain high strength cold reduced steel sheet having high bake-hardenability and excellent non-aging property.

In the prior art it is well known that the development of a cold reduced steel sheet had been directed to those with low yield point, i.e. so-called soft steel sheet. However, in pursuing safety of vehicles, particularly of passenger cars, the demand for a high strength cold reduced steel sheet is increasing. However, using such a high strength steel sheet for the pressed parts of the car body would encounter various problems, particularly in the press-shapability (shape-keepability) and press-formability. These problems would be nil if the sheets used were soft. Accordingly, a desirable high strength steel sheet for press forming would be such that it is soft during the press forming operation and then hardens as it is subjected to coating and baking. There has been proposed a method as an improvement to this steel which causes a great amount of solute [N] to be retained in steel and then to cause the said [N] to precipitate on free dislocation during the coating and baking process, thereby raising its yield point.

An example of such art is the so-called AA (accelerated aging) steel sheet developed by the Inland Steel Company, USA, which adds about 100 ppm Nitrogen at steel making stage to raise its strength by a heating treatment after press forming. However, this type of steel sheet is not used universally for the panels in the car body today. Various reasons are conceivable, but one reason would be that its strain aging is excessive and stretcher-strain tends to appear at the pressed portion. This is because of the presence of a great amount of solute nitrogen which exerts an unfavorable influence on aging, and this is to be foreseen naturally from the theoretical point of view. Although the said AA steel sheet is effective in raising the strength by the aging effect of nitrogen as abovementioned, the said effect is not without its limitations. For instance, the tensile strength is as low as 40 - 50 Kg/mm$^2$. Thus, the high tensile strength cold reduced steel sheets having both excellent non-aging property and high bake-hardenability at the time of plating-baking are still not available in the market, although various proposals have been made.

The present invention was made to overcome the disadvantages as above outlined. The features of the invention lie in the controlling of the composition at steel making stage and in the continuous annealing process following cold reducing. First, stating the composition, Mn amount is specified to be within the range of 10 $\times$ [S] to 2.00% in its relation to [S]. Al amount to be $<$ 5 $\times$ 10$^{-4}$/[N]% in its relation to [N], and [N] controlled to be 0.003 to 0.02%. In the continuous annealing process after cold reducing the crystal structure of the above steel was caused to become a two phase structure of ferrite-martensite. With the above treatments, it becomes possible to retain a great amount of solute [N] in steel and at the same tiime to prevent strain aging caused by this solute [N]. More concretely, the steel sheet is heated up to $Ac_1$ - 900° C for 5 - 180 seconds, quenched in the water jet stream, and then is subjected to a slight temper treatment of 150° - 450° C $\times$ 5 - 300 seconds.

An object of this invention is to provide a high strength cold reduced steel sheet having both high bake-hardenability and excellent non-aging property by a full continuous annealing process.

Another object of this invention is to provide a high strength cold reduced steel sheet which is soft at the press-forming stage and then becomes hard at the coat-baking stage.

A further object of this invention is to provide a high strength cold reduced steel sheet being securable safety of a vehicle, e.g. car body.

Other objects and advantages will be apparent from the following description and with the accompanying drawings in which.

Figure 1:
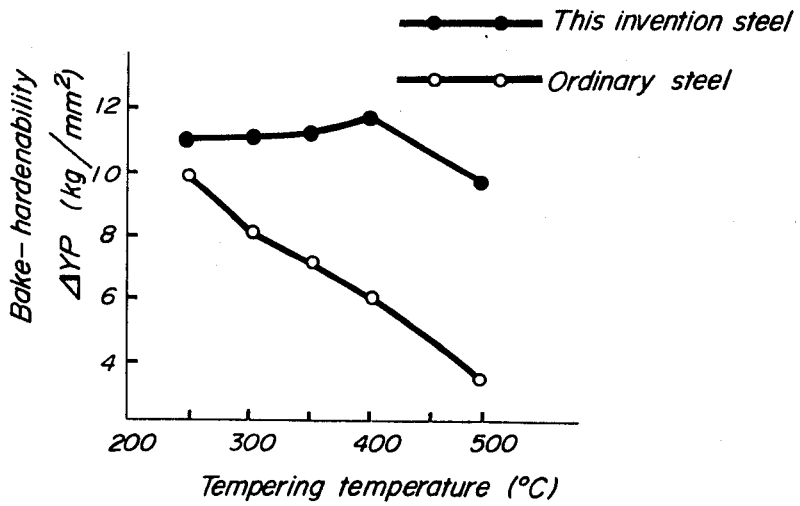
FIG. 1 is a graph showing changing manners of bake-hardenability of this invention steel by tempering temperatures in comparison with those of ordinary steel.

The chemical composition of steel in the present invention is controlled as per follows, the fundamental composition being substantially;

C: 0.02 to 0.12;
Mn: 10[S] to 2.00%, ([S] ; S weight %);
N: 0.03 to 0.2%, preferably 0.005 to 0.015%;
Al: 5 $\times$ 10$^{-4}$/[N] %, ([N] ; N weight %)

Further, one or more elements selected from the following group may be added depending on the needs:

P: 0.03 to 0.20%,
Cu: 0.2 to 1.5%,
Nb: 0.01 to 0.20%,
Si: 0.2 to 2.0%,
V: 0.02 to 0.2%.

A steel as above mentioned is hot rolled, pickled, cold-reduced by normal manner and then continuously annealed under the following requirements;

Heating temperature & time: $Ac_1$ to 900° C $\times$ 5 to 180 seconds

Quenching method: water quenching in jet stream

Quenching temperature: $Ac_1$ to 900° C.

Reheating temperature & time: 150° to 450° C $\times$ 5 to 300 seconds.

Other requirements such as a heating rate, a final cooling rate, etc. may be the same as those employed in the ordinary continuous annealing. Temper rolling may also be conducted under usual requirements.

The features of the steel sheet thus treated in accordance with the present invention are more than surprising, the said main features being: bake-hardenability at 170° C $\times$ 20 minutes shows at least 7Kg/mm$^2$ improvement at yield point. And more, its tensile strength is no less than that before baking, but is maintained at the same level. This indicates that the steel is easy to press in forming the automobile parts and yet excellent in retaining the pressed shape, and still more its yield strength radically rises in the completed products after, coat-baking treatment. Thus, it may be said that this invention steel makes esy processing. Another feature is that recovery of yield point elongation after accelerated aging of 38° C $\times$ 8 days is far less than the aimed value of 1%. The reasons why the steel sheet of the present invention shows excellent nonaging property in spite of a great amount of soluted [N] content are to be elucidated by the future theoretical analysis, but it is assumed that 3 to 40% martensite phase, which is formed in steel by this invention process as the second phase, becomes the source of a generation of new free dislocations, that is, of invisible very fine Luders Bands in the vicinity of the second phase. In any event, the above mentioned various properties of the steel sheet in accordance with the present invention are caused by the formation of the two phase structure of ferrite-martensite by the water quenching in a jet stream from an intercritical temperature and the successive reheating - low temperature tempering.

In the present invention process which brings about high bake-hardenability and excellent non-aging property, there have been placed various restrictions as above mentioned and the reasons therefor are described below.

C: In the said fundamental composition changes the structure of steel to the two phase structure of ferrite-martensite and gives a suitable strength to steel. C content below 0.02% will not bring about these effects while that of above 0.12% will deteriorate press formability and cause lowered elongation rate and r values.

Mn: The lower limit of Mn was set at 10 × [S]% because of the red shortness caused by FeS. The upper limit was set at 2.00% in view of the press formability as in the case of [C].

N: N is a component which plays a significant role in the present invention process. Accordingly, its lower limit was set at 0.003% and upper limit, at 0.02% to enhance the bake-hardenability of the steel sheet. If [N] content exceeds the above limit, the steel will show inferior press formability and would render cold reducing impossible in some cases. Therefore, the range of 0.005 to 0.015% is most preferable for [N] content to obtain a steel sheet with most excellent bake-hardenability, non-aging property and press-formability. The upper limit of [Al] was set at $5 \times 10^{-4}$/[N]% in order to avoid precipitation of [N] in the form of [AlN] during the heating process.

In order to give further strength and workability to the steel substantially consisting of the above mentioned elements, one or more elements selected from the following group with which nitride is not formed or with which it is difficult to form nitride during the manufacture is added as the need arises. The lower limit for these elements indicate the least requirement for improvement of strength and press formability, respectively.

P: 0.03 to 0.20%. The upper limit was set at 0.20% because [P] content exceeding the said limit deteriorates spot weldability.

Si: The lower limit of [Si] was set at 0.2% and the upper limit, at 2.0% in view of the press formability.

Cu: The lower limit of [Cu] was set at 0.2% and the upper limit, at 1.5% in order to curb an occurrence of so-called Cu defects on surfaces.

V: V should be contained in the range of 0.02% to 0.2%. The reason for setting this upper limit is that [N] precipitates in a great amount as VN and an addition above this limit does not raise the strength in proportion to the increasing of [V] content.

Nb: The same is true of limiting [Nb] content to 0.01 - 0.2%. Effectiveness of the above element is additive so that it is preferable for press formability to control [C] content to a lower value when adding these elements.

The steel which composition is controlled as mentioned above is hot rolled pickled and cold reduced under the usual requirements and the obtained strip is continuously annealed in strand form. The reasons for the above-mentioned limit to the full continuous annealing process are given below.

As for the heating requirements, the strip is heated to $Ac_1$ to 900° C at a normal rate and is held for 5 to 180 seconds in this temperature range. The lower limit is set at $Ac_1$ to obtain a suitable martensitic phase by quenching from this temperature. The upper limit is set at 900° C. because the quenching structure at a higher temperature than the above will completely become martensitic phase alone and is therefore not preferable in view of press formability and strain aging property. In order to have the recrystallization completed within such a temperature range and to let austenite partially form, which then becomes the base of the martensitic phase, during heating, at least five seconds are required. However, if it is held for more than 180 seconds and if Al is contained in the steel, [N] would be precipitated as AlN and productivity in view of the facilities would be lowered.

The same reasons as for setting the heating temperature apply to setting the temperature at which quenching is started. That is, the range of said heating temperature range is the range for starting quenching. Quenching from this temperature is performed by water quenching in jet a steam. In this case, it was found that a quenching rate faster than a mere hardening in still water was necessary to securely form the martensitic phase in a low carbon steel such as C < 0.12% in spite of the fact that quenching is started at a temperature as low as $Ac_1$ — 900° C. Accordingly, water quenching in the jet stream becomes necessary to obtain the present quenching rate industrially. Adoption of water quenching in a jet water stream will facilitate upkeep at the same level of r value (average plastic strain ratio) as that of the high class cold reduced steel sheet. Any other method of slower quenching rate does not realize this level. The reasons for water quenching in the jet stream in this invention lie in these points.

Reheating treatment of 150° to 450° C × 5 to 300 sec. is performed on the strip which has been cooled down to room temperature by the above mentioned quenching. This reheating should be carried out to prevent the lowering of strength in a coat-baking process after press forming. That is to say, it is necessary to let the required amount of solute [C] in steel precipitate and more to let martensite previously change into a form more stable as above mentioned during heating-quenching. Letting a part of solute [C] remain in steel without precipitating the whole amount in the reheating treatment i.e. low temperature tempering process is recommended to enhance the above mentioned bake-hardenability. The lower limit of such reheating requirements should be set at 150° C × 5 sec. One of the reasons for this is to let the great amount of solute carbon in ferrite by the said quenching precipitate to a certain degree so that the coat-baking treatment after press forming would not lower strength. A second reason is to stabilize the martensitic phase, without changing, during the coat-baking treatment.

The upper limit of the said reheating temperature was set at 450° C because martensite softens excessively at above the said temperature and non-aging property would be damaged. Besides, the strength of steel sheet itself would also be lowered, thus damaging the quenching effect as against the strength imparted. The upper limit of reheating time was set at 300 seconds because of the reasons of facilities and productivity thereby.

The present invention is now explained with reference being made to actual manners thereof and its effects are described in further detail referring to many comparative examples and the following examples of this invention.

EXAMPLE 1

The present example pursued the influences of the heat cycle in the full continuous annealing process. The steel used in this example was one of the following composition based on this invention.

| | |
|---|---|
| Composition | C: 0.06%<br>Mn: 0.28%<br>P: 0.012%<br>S: 0.018%<br>N: 0.0075% |

Making requirements (experiments)
Excepting continuous annealing process as shown in Table I, main requirements (as usual) are as follows.
Final thickness after cold reducing: 0.8mm
Temper rolling: 1.0%
Coat-baking treatment: 170° C × 20 minutes
Accelerated aging: 38° C × 8 days
Mechanical properties:
Table I shows the influences of the heating cycles it showed inferior bake-hardenability and further extremely inferior aging property.

Steels 1-3,1-4 and 1-5 were checked for the relation between the heating temperature and the steel quality. The heating temperature for Steel 1-3 was set as low as 700° C, but the manners of quality are substantially similar to those for the said Steel 1-2. That is, the steels were found defective in yield point elongation, bake-hardenability and aging property.

Steel 1-4 was manufactured in accordance with the present invention process and the heating temperature was set at 800° C. Although it showed a very high BH property of ΔYP: 11.1Kg/mm², the recovery of the yield point elongation after accelerated aging was as low as 0.2%. Thus, the steel may be called substantially non-aging.

Heating temperature for Steel 1-5 was set comparatively higher than the present invention, at 920° C. Its elongation was inferior for the comparatively high strength and its bake-hardenability and aging property were also inferior to that of the present invention Steel. Thus, it will be understood that the heating temperature in the continuous annealing process should be set in accordance with the present invention.

Steels 1-6 to 1-11 were checked in respect of the influences that a tempering temperature exerts on quality of steel First, Steel 1-6 showed a defect which may be called detrimental for a steel, that is, its strength lowered by the baking treatment.

Table I

°: Heat cycle based on this invention

| Steel | Heat cycle | Testing subject |
|---|---|---|
| 1 - 1 | 700° C × 2hr. Batch type annealing | Comparative cycle |
| 1 - 2 | 700° C × 1min. Continuous annealing for tin plate | Comparative cycle |
| 1 - 3 | 700° C × 1min.→WQ→300° C × 1min. | Heating temperature |
| ° 1 - 4 | 800° C × 1min. " | " |
| 1 - 5 | 920° C × 1min. " | " |
| 1 - 6 | 800° C × 1min.→WQ | Tempering temperature |
| 1 - 7 | 800° C × 1min.→WQ→100° C × 1min. | " |
| ° 1 - 8 | " | ° C × 1min. " |
| ° 1- 9 | " | 350° C × 1min. " |
| ° 1 - 10 | " | 400° C × 1min. " |
| 1 - 11 | " | 500° C × 1min. " |
| 1 - 12 | "→Quenching into→250° C × 1min. still water | Rapid cooling method |
| 1 - 13 | "→Forced air → " -cooling | " |

| Mechanical Properties just after temper-rolling | | | | | | | | After accelerated aging |
|---|---|---|---|---|---|---|---|---|
| YP Kg/mm² | YPEl % | TS Kg/mm² | El % | r̄ Value | YP Kg/mm² | TS Kg/mm² | YP Kg/mm² | YPEl % |
| 23.7 | 0 | 34.3 | 44.2 | 1.27 | 32.0 | 34.6 | 8.3 | 2.5 |
| 29.2 | 1.8 | 37.2 | 36.5 | 0.87 | 35.3 | 37.9 | 6.1 | 4.6 |
| 30.0 | 2.0 | 38.2 | 35.9 | 1.02 | 36.2 | 38.8 | 6.2 | 3.1 |
| 32.5 | 0 | 44.2 | 32.9 | 1.25 | 43.6 | 44.6 | 11.1 | 0.2 |
| 35.2 | 0 | 47.1 | 22.1 | 1.30 | 42.5 | 47.5 | 7.3 | 1.2 |
| — | — | 69.1 | 7.2 | 1.23 | 46.3 | 47.5 | — | — |
| 38.3 | 0 | 59.3 | 16.3 | 1.23 | 45.2 | 47.9 | 6.9 | — |
| 33.8 | 0 | 45.3 | 32.0 | 1.24 | 44.8 | 45.5 | 11.0 | 0.2 |
| 30.6 | 0 | 42.1 | 35.4 | 1.26 | 41.8 | 42.6 | 11.2 | 0.3 |
| 28.2 | 0 | 40.8 | 37.2 | 1.25 | 39.9 | 40.9 | 11.7 | 0.6 |
| 26.3 | 0 | 38.2 | 37.6 | 1.24 | 36.0 | 38.9 | 9.7 | 1.2 |
| 31.0 | 0 | 38.9 | 29.7 | 0.98 | 36.2 | 38.8 | 5.2 | 2.7 |
| 28.6 | 0 | 37.4 | 33.5 | 0.89 | 32.5 | 37.1 | 3.9 | 3.8 |

Note: WQ shows quenching into water-jet.

As is demonstrated in Table I, Steel 1-1 was subjected to a normal batch type annealing. Its bake-hardenability, i.e. ΔYP is comparatively large at 8.3Kg/mm², but its yield point elongation after accelerated aging is as high as 2.5%, rendering the steel not so preferable.

Steel 1-2 was subjected to an ordinary continuous annealing cycle for tin-plating. The yield point elongation tends to remain even after temper roller rolling and Secondly Steel 1-7 had its tempering temperature set lower than the present invention process. When tempered at such a temperature, some improvement was seen over the above mentioned Steel 1-6, but its tensile strength dropped radically from 59.3Kg/mm² to 47.9Kg/mm², which is not desirable.

Thirdly, Steels 1-8, 1-9 and 1-10 were manufactured in accordance with the present invention. These steels showed great bake-hardenability and excellent nonaging property over a wide range of tempering temperature of 250° to 400° C. Such a small susceptibility toward low tempering temperature is most preferable for an operations in a steel works. This naturally is caused by the addition of N. However, as described above, N addition along would not produce such excellent results if the heating cycle were outside the range of the present invention. The same is true of Steel 1-11, which was subjected to a higher tempering temperature of 500° C ° 1 minute, outside the range of the present invention. As is clear from the Table I, YPEL, setting aside its strength, showed a great recovery rate of 1.2% after accelerated aging, indicating its disadvantage. Thus, the tempering treatment in the full continuous annealing process should be limited as in the above instance.

The above Steels 1-7 to 1-11 are the representative examples of the numerous experiments carried out in respect of tempering treatment. FIG. 1 shows the summary of these experiments, the variation of bake-hardening property at the said tempering temperature along with those of comparative steels. A comparative steel used herein to which no N addition was made consists of the following elements and was manufactured under the same requirements including the heating cycle as the above steels.

C: 0.05%
P: 0.01%
N: 0.0017%
Mn: 0.27%
S: 0.027%

This is a low carbon capped steel. According to FIG. 1, the comparative steel (usual steel) showed a radical decrease in bake-hardenability as the tempering temperature rose, while the steel to which N was added in accordance with the present invention showed no dependancy on the tempering temperature. This is the tempering treatment of N added steel in accordance with the present invention.

Effects of the quenching method were checked with Steels 1-12 and 1-13. As is clearly demonstrated by the comparison of these steels with the above Steels 1-4, 1-8, 1-9 and 1-10, such a slow cooling as the quenching in still water or the forced air cooling, which are far slower than the water quenching in jet stream in accordance with this invention, does not impart sufficient strength, damages the balance in TS-EL, and also results in inferior bake-hardenability. Data concerning *r* value further indicate that the quenching in the water jet stream is indispensable for the present invention process. As is seen in the case of Steels 1-4, 1-8, and 1-9 by the present invention process, the *r* value reaches the level of ordinary cold rolled steel sheet i.e. 1.24 to 1.26, where Steels 1-12 and 1-13, which were quenched in still water or subjected to forced air cooling, indicated very low levels of *r* value, i.e. 0.98 and 0.89, proving unsuitable for press forming. As has been described above, quenching into the water jet stream in the continuous annealing process is an indispensable step in the present invention.

EXAMPLE 2

Effects of N addition on the stableness of bake-hardening property were then investigated. The basic baking requirements in a coating process are normally 170° C × 20 minutes. However, it is known that the above requirements are not always met for the concave parts of a body where it is difficult for the hot air to reach. It is also known through experiences that the temperature of the hot air is not always controlled to be 170° C. Therefore, it is desirable that high bake-hardening property is stably obtained even with slight variations in the above mentioned baking requirements. The present example was carried out with this view as above explained.

The test steel of the present example was manufactured under the following requirements. Composition of specimen (%)

| | C | Mn | P | S | N | Si |
|---|---|---|---|---|---|---|
| N addition Steel | 0.052 | 0.28 | 0.01 | 0.018 | 0.0092 | 0.12 |
| no-N addition steel | 0.055 | 0.23 | 0.01 | 0.019 | 0.0014 | 0.08 |

Note:
Si was added to control deoxidation

Main making requirements

Continuous casting was employed for the steels
Final thickness after hot rolling: 3.2mm
Final thickness after cold reducing: 0.8mm
Heat Cycle for continuous annealing
Heating requirements: 750° C × 1 minute
Quenching temperature: 750° C
Quenching in the water jet stream;
Tempering requirements: 270° C × 1 minute
Temper rolling rate: 1%

Coat-baking requirements:

Five steps of 100° C, 120° C, 140° C, 160° C and 170° C for 20 minutes each

Mechanical properties just after temper rolling and prior to baking are as follows.

| | YP | YPEL | TS | El |
|---|---|---|---|---|
| N addition Steel | 29.5 | 0% | 42.5Kg/mm² | 57.0% |
| no-N addition steel | 27.8 | 0% | 39.3Kg/mm² | 38.3% |

Figure 2:
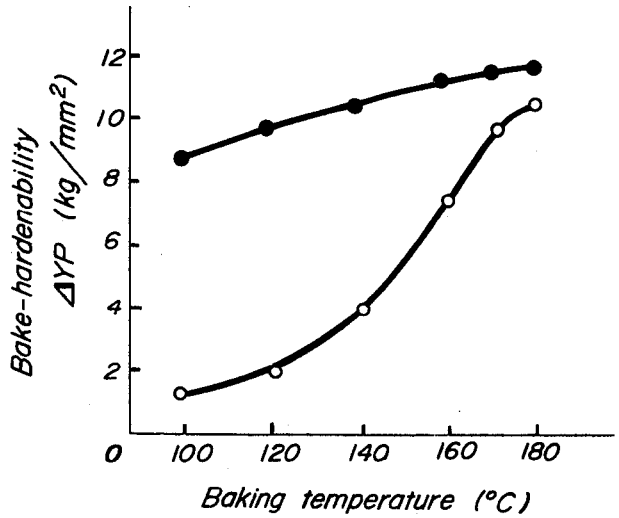
FIG. 2 is a graph showing changing manners of bake-hardenability of this invention steel by baking-temperatures in comparison with those of ordinary steel.

Variation in bake-hardening property of these steels under the above mentioned baking requirements are shown in FIG. 2. It will be known from the said figure that bake-hardening property for the ordinary steel radically lowers as the baking temperature lowers. Conversely, the steel to which N was added in accordance with the present invention showed that the above tendency is widely improved. For instance, bake-hardenability as high as 10Kg/mm² was obtained even at 120° C. The stability which is not greatly disturbed by the changing of baking temperature is one of the causes for stable operation along with very small sensitivity toward tempering temperature as indicated in the above Example 1.

EXAMPLE 3

The present example pursued the influences of the chemical composition. Thus, the following main making requirements were employed for the steels.

Finishing thickness after hot rolling: 2.8mm
Final thickness after cold rolling: 0.8mm
Heating cycle for continuous annealing;
Heating requirements: 800° C × 1 minute
Quenching requirements: quenching in water jet stream from 800° C
Tempering requirements: 400° C × 1 minute Temper rolling rate: 1.0%

Coat-baking requirements: 170° C × 20 minutes

Accelerated aging test: recovery amount of YPE1 after accelerated aging of 38° C × 8 days The mechanical properties obtained by these requirements are given in Table II.

Table II

| Steels | C | Mn | N | Al | Special elements | [Al%] x[N%] x10⁴ | Testing subject |
|---|---|---|---|---|---|---|---|
| | ° Invention steel | | | | | | |
| | Composition (%) | | | | | | |
| 3 - 1 | 0.06 | 0.23 | 0.0014 | 0.001 | | 0.01 | Influence by [N] |
| ° 3 - 2 | 0.05 | 0.23 | 0.0033 | 0.001 | | 0.03 | " |
| ° 3- 3 | 0.06 | 0.28 | 0.0056 | 0.001 | | 0.08 | " |
| ° 3 - 4 | 0.04 | 0.22 | 0.0138 | 0.001 | | 0.15 | " |
| 3- 5 | 0.04 | 0.28 | 0.0250 | 0.001 | | 0.25 | " |
| ° 3 - 6 | 0.05 | 0.25 | 0.0071 | 0.045 | | 3.20 | Influence by [Al] |
| 3 - 7 | 0.05 | 0.21 | 0.0102 | 0.053 | | 5.41 | " |
| ° 3 - 8 | 0.09 | 0.32 | 0.0035 | 0.001 | | 0.04 | Influence by [C] |
| 3 - 9 | 0.14 | 0.35 | 0.0032 | 0.001 | | 0.03 | " |
| ° 3 - 10 | 0.06 | 1.05 | 0.0038 | 0.035 | | 1.33 | Influence by [Mn] |
| 3 - 11 | 0.08 | 2.20 | 0.0035 | 0.050 | | 1.75 | " |
| ° 3 -12 | 0.05 | 0.32 | 0.0065 | 0.010 | P 0.12% | 0.98 | Effect by addition of P |
| ° 3 - 13 | 0.06 | 0.38 | 0.0078 | 0.005 | Si 1.02% | 0.39 | Si " |
| ° 3 - 14 | 0.06 | 0.35 | 0.0059 | 0.013 | Cu 0.98% | 0.77 | Cu " |
| ° 3 - 15 | 0.05 | 0.33 | 0.0063 | 0.035 | P 0.07% Si 1.02% | 2.21 | P-Si " |
| ° 3 - 16 | 0.05 | 0.42 | 0.0075 | 0.009 | P 0.10% Nb 0.04% | 0.68 | P-Nb " |
| ° 3 - 17 | 0.05 | 0.35 | 0.0082 | 0.012 | Si 0.3% P 0.10% V 0.10% | 0.98 | Si-P-V " |
| ° 3 - 18 | 0.06 | 1.05 | 0.0095 | 0.015 | Si 1.2% Nb 0.03% | 1.43 | Mn-Si-Nb " |

| Mechanical properties just after temper-rolling | | | | After bake-treating | | | After accelerated aging |
|---|---|---|---|---|---|---|---|
| YP Kg/mm² | YPEl % | TS Kg/mm² | El % | YP Kg/mm² | TS Kg/mm² | YP Kg/mm² | YPEl % |
| 26.2 | 0 | 38.5 | 37.9 | 31.6 | 39.0 | 5.4 | 0 |
| 26.5 | 0 | 39.2 | 36.3 | 36.0 | 39.3 | 9.5 | 0 |
| 28.9 | 0 | 41.5 | 34.0 | 40.2 | 41.5 | 11.3 | 0.3 |
| 30.5 | 0 | 43.2 | 32.0 | 42.5 | 43.7 | 12.0 | 0.3 |
| 33.5 | 0 | 45.6 | 25.2 | 45.2 | 45.6 | 11.7 | 0.7 |
| 32.0 | 0 | 45.8 | 32.1 | 39.5 | 45.5 | 7.5 | 0 |
| 34.3 | 0 | 47.3 | 30.5 | 37.8 | 47.8 | 3.5 | 0 |
| 36.1 | 0 | 49.5 | 26.2 | 45.2 | 49.8 | 9.1 | 0.1 |
| 45.0 | 0 | 57.6 | 14.5 | 53.2 | 57.7 | 8.2 | 0.2 |
| 44.0 | 0 | 58.9 | 22.6 | 54.9 | 59.3 | 10.9 | 0.2 |
| 54.8 | 0 | 72.3 | 15.0 | 64.0 | 73.2 | 9.2 | 0 |
| 35.2 | 0 | 48.5 | 32.2 | 48.2 | 49.1 | 13.0 | 0.2 |
| 40.2 | 0 | 55.3 | 30.5 | 53.0 | 55.5 | 12.8 | 0.1 |
| 38.5 | 0 | 52.5 | 30.0 | 50.8 | 53.0 | 12.3 | 0.2 |
| 44.3 | 0 | 60.3 | 28.0 | 54.3 | 61.0 | 10.0 | 0 |
| 42.0 | 0 | 55.2 | 28.2 | 52.9 | 56.0 | 10.9 | 0.2 |
| 43.2 | 0 | 59.3 | 27.9 | 54.9 | 60.0 | 11.7 | 0.2 |
| 56.2 | 0 | 75.3 | 22.2 | 68.9 | 75.8 | 12.7 | 0.2 |

Note: [S]in the above steels; 0.005 - 0.023%

In the Table II, effects of [N] were checked in Steels 3-1, to 3-5. Steels 3-2, 3-3 and 3-4 among them the steels of the present invention. Steel 3-1 shows a very low value of [N] at 0.0014% and also of ΔYP at 5.4Kg/mm². Whereas Steels 3-2 to 3-4 of which [N] range is within that of the present invention showed high ΔYP of 9.5Kg/mm², 11.3Kg/mm² and 12.0Kg/mm², respectively. That the yield point elongation after the accelerated aging is as low as 0 - 0.3% substantially shows non-aging property. It should be noted that Steels 3-3 and 3-4 containing 0.0056% and 0.0138% of [N] showed higher ΔYP value than that of Steel 3-2 containing 0.0033% [N]. It has been thus confirmed that the effect of [N] becomes more remarkable when the baking temperatures are lower. For instance, when the baking requirements of 140° C × 20 minutes are employed, bake-hardening property (ΔYP) radically lowers to 6.8Kg/mm² for Steel 3-2 of low [N] content. On the other hand, for Steels 3-3 and 3-4 of 0.0056% and 0.0138% [N] contents, its bake-hardenability is held, respectively, at 10.5Kg/mm² and 11.2Kg/mm². However, it was recognized that [N] content naturally had its limitations and lacked a well balanced mechanical properties in a case of [N] content exceeding the limit. One such example is found in Steel 3-5 which contained 0.0025% of [N] exceeding the limit of the present invention. It showed a low El value of 25.2%. This is quite unsatisfactory for the steel sheet intended for press forming. Generally speaking, when the tensile strength is in a class of 45Kg/mm², at least 30% of elongation is required. In order to hold the necessary YP value and to obtain well balanced quality, [N] should be controlled to be within the range of this invention of 0.003% to 0.020%.

[Al] effect was checked in respect of Steels 3-6 and 3-7. Steel 3-6 containing [Al] within the range of this invention i.e. $<5 \times 10^{-4}$/[N]% showed far higher bake-hardenability than that of Steel 3-7 containing [Al] in excess of the above limit.

[C] effect was checked in respect of Steels 3-8 and 3-9. Steel 3-8 containing [C] within the range of this invention showed a comparatively good tensile strength and elongation, but Steel 3-[9 which was outside the range of this invention showed a lower elongation as compared to its high tensile strength. Considering that the elongation required for the tensile strength of 5.8Kg/mm² were to be at least 22%, then this Steel 3-9 is not at all suitable for this requirement. Although not shown in Table II, *r* value of Steel 3-8 was 1.1 while that of Steel 3-9 was 0.9. This is a grave defect for the steel for press forming.

[Mn] was checked in respect of Steels 3-10 and 3-11. Steel 3-10 of which [Mn] content is within the range of this invention showed a good TS-El balance, but Steel 3-11 containing [Mn] in excess of the range of this invention showed 15% El as against 72Kg/mm² TS. In such a case, the fact that at least 18% elongation is required for the value of TS were to be considered, then it will be understood that Steel 3-11 is not preferable. Although not shown in Table II, *r* value of Steel 3-11 is extremely low at 0.85 and is unsuitable for press forming.

Addition effects of special elements were checked in respect of Steels 3-12 to 3-18. In each case, well balanced mechanical properties and excellent bake-hardening and non-aging properties were shown. The main reason for adding the special elements is for improved press formability by improving the mechanical properties which will become naturally clear from the TS-El balances where these special elements are added as compared to other cases as mentioned above. For instance, the above Steel 3-10 (1.05% Mn) which lies within the range of this invention shows 58.9Kg/mm² TS - 22.6% El. On the other hand, though Steel 3-15 to which [Si] - [P] are added showed further elevated values of 60.3Kg/mm² TS, its value of El is very high as shown in Table II.

Thus, the present invention facilitates an easy and stable manufacture of a high strength cold rolled steel sheet with both high bake-hardenability and excellent non-aging property.

We claim:

1. A process of making a high strength cold reduced steel having both high bake-hardenability and excellent non-aging property consisting essentially of controlling the chemical composition of the steel within the following range in the steel making stage:

| | |
|---|---|
| C | 0.02 to 0.12% |
| Mn | 10 × [S] to 2.00% |
| [N] [N] | 0.003 to 0.02% |
| Al | $<5 \times 10^{-4}$/[N] % |
| [S] [S] | 0.005 to 0.023%, |

the steel is hot rolled, pickled and cold reduced, and the cold-reduced steel strip so obtained is subjected to the following full continuous annealing process:

| | |
|---|---|
| heating-up step | $Ac_1$ to 900° C. |
| holding time | 5 to 180 seconds at a temperature of from $Ac_1$ to 900° C. |
| rapid cooling step | quenching to room temperature from $Ac_1$ to 900° C. in a water jet stream |
| reheating step | from the room temperature to a temperature of from 150 to 450° C. |
| tempering step | holding at a temperature of from 150 to 450° C. for from 5 to 300 seconds, and |
| final step | cooling from 150 to 450° C. to room temperature and coiling. |

2. The process of claim 1, wherein [N] is from 0.004 to 0.015%.

3. The process of claim 1, wherein said composition contains 0.03 to 0.20% P.

4. The process of claim 1, wherein said composition contains 0.02 to 2.0% Si.

5. The process of claim 1, wherein said composition contains 0.2 to 1.5% Cu.

6. The process of claim 1, wherein said composition contains 0.05 to 0.20% V.

7. The process of claim 1 wherein said composition contains 0.02 to 0.20% Nb.

* * * * *

UNITED STATES PATENT AND TRADEMARK OFFICE

CERTIFICATE OF CORRECTION

PATENT NO. : 4,050,959

DATED : September 27, 1977

INVENTOR(S) : KAZUHIDE NAKAOKA et al

It is certified that error appears in the above-identified patent and that said Letters Patent are hereby corrected as shown below:

Column 2, line 61: after "after", replace the comma with --- a ---.

Column 2, line 63: rewrite "esy" as --- easy ---.

Column 4, line 28: replace "jet a" with --- a jet ---.

Column 5, Table 1: insert --- 250 --- before "°Cx1 minute" at "Steel 1-8".

Column 5, Table 1: at "Steels 1-8 through 1-11", each recitation of "...°Cx1 minute" should be moved one column to the left.

Column 5, line 59: "Note:..." should be printed directly under "Table I".

Column 5, line 68: delete "roller".

Column 6, line 27: after "steel", insert a period.

Column 7, line 6: replace "along" with --- alone ---.

Column 7, line 10: after "500°C", insert --- x --- (the multiplication symbol).

UNITED STATES PATENT AND TRADEMARK OFFICE

CERTIFICATE OF CORRECTION

PATENT NO. : 4,050,959
DATED : September 27, 1977
INVENTOR(S) : KAZUHIDE NAKAOKA et al It is certified that error appears in the above-identified patent and that said Letters Patent are hereby corrected as shown below:

Column 9, line 47: "Note:..." should be printed directly under "Table II".

Column 10, line 64: before "9", delete "[".

Column 12, line 6: delete "[N] [N]" and replace with --- [N] ---.

Column 12, line 8: delete "[S] [S]" and replace with --- [S] ---.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*